United States Patent [19]

Butler

[11] 4,426,044

[45] Jan. 17, 1984

[54] DOCUMENT SHREDDING MACHINES

[75] Inventor: George T. Butler, Leigh, England

[73] Assignee: Frank R. Ford Limited, Westbank, England

[21] Appl. No.: 927,920

[22] Filed: Jul. 25, 1978

Related U.S. Application Data

[63] Continuation-in-part of Ser. No. 756,389, Jan. 3, 1977, abandoned.

[30] Foreign Application Priority Data

Jan. 2, 1976 [GB] United Kingdom ..... 476

[51] Int. Cl.[3] ..... B02C 18/18

[52] U.S. Cl. ..... 241/236; 83/675

[58] Field of Search ..... 241/236; 83/500–503, 83/675

[56] References Cited

U.S. PATENT DOCUMENTS

| | | | |
|---|---|---|---|
| 3,033,064 | 5/1962 | Lee | 83/500 X |
| 3,860,180 | 1/1975 | Goldhammer | 241/236 X |
| 3,960,335 | 6/1976 | Haberle | 241/236 |

FOREIGN PATENT DOCUMENTS

| | | | |
|---|---|---|---|
| 2524086 | 12/1976 | Fed. Rep. of Germany | 241/236 |

*Primary Examiner*—Mark Rosenbaum

*Attorney, Agent, or Firm*—Shlesinger, Arkwright, Garvey & Fado

[57] ABSTRACT

A document shredding machine comprising a cutter assembly including cutter discs mounted separately in two rows on respective shafts for rotation in opposite directions about respective parallel axes, the discs of one row being arranged to enter gaps between the discs of the other row, wherein each disc is formed with a plurality of notches in its periphery and axially successive discs along the length of the cutter assembly are arranged with their notches circumferentially staggered in relation to one another in such a way as to eliminate the jerky action which occurs if the notches are aligned with one another and in such a way as to prevent an overall tendency for axial movement of the discs if the notches are progressively and uniformly offset from one another.

5 Claims, 5 Drawing Figures

DOCUMENT SHREDDING MACHINES

CROSS REFERENCE TO RELATED APPLICATIONS

This application is a continuation-in-part of copending application Ser. No. 756,389 filed Jan. 3, 1977, now abandoned.

BACKGROUND OF THE INVENTION

1. Field of the Invention

This invention relates to document shredding machines of the kind comprising a cutter assembly including two rows of cutter discs mounted for rotation in opposite directions about respective parallel axes, the discs of one row being arranged to enter gaps between the discs of the other row with little or no clearance so that the overlapping discs collectively act to cut material fed into the nip of the cutter assembly into narrow strips. Such machines are hereinafter referred to as being "of the kind specified".

2. Description of the Prior Art

It has been proposed to sever the long strips of material thus formed into short lengths by forming in the periphery of each disc a plurality of angularly spaced cutouts or notches so arranged that the notches in any pair of adjacent overlapping discs, one from each row, do not register with one another as the discs rotate. This effectively ensures that the strips are cut or torn into short lengths substantially corresponding to the spacing between successive notches in the periphery of the discs, the transverse edges which interrupt the peripheral cutting edges of the discs serving to make transverse incisions in the material.

However, in one prior proposal the notches on all the discs of each row are arranged in straight lines parallel to the axis of rotation. This arrangement has the disadvantage that the transverse edges which interrupt the cutting edges of the discs in either row all engage the material simultaneously and there is a sudden increase in the resistance presented to rotation of the discs. This is repeated regularly as each row of notches comes into contact with the material being cut and results in a noisy, jerky action and requires a driving motor of greater power than would be the case if the cutters could be made to operate smoothly.

In one attempt to overcome this problem, it has been proposed to arrange the notches in each row of discs generally on a helix so that in each row the notches of adjacent discs are somewhat offset circumferentially in the same sense in a regular manner from those of adjacent discs. Thus, the transverse edges previously mentioned contact the material progressively along the length of the row and the cutting load is evened out.

This solution may be satisfactory where the cutter discs are immovable axially, for example where each row of discs is formed from a single roller which is milled to define the individual discs. However, such constructions are very expensive to produce, especially where the discs are required to be particularly thin so as to cut the material into fine strips. In an alternative and less expensive type of arrangement, the cutter discs can be formed as individual discs mounted on a shaft with interfitting formations so that the disc is rotated by the shaft. Normally, the shaft is provided with a keyway and the discs are centrally apertured to fit on such shaft and provided with an inwardly projecting tang to enter the keyway, or the shaft may be formed with an axially extending rib, the aperture of each disc having a peripheral recess in which said rib engages or the shaft may be of non-round sections, the apertures of the discs being shaped correspondingly. This construction inevitably allows the discs some freedom for axial movement and it has been found that if such discs are formed with notches arranged generally helically, in use, the discs tend to move axially in one direction so as to become packed tightly together at one end of the shafts on which they are mounted and thus give rise to a substantial increase in frictional resistance to rotation.

SUMMARY OF THE INVENTION

To overcome this problem the present invention provides, in a document shredding machine of the kind specified wherein the cutter discs are mounted separately in said rows on respective shafts, an arrangement whereby the notches on axially successive discs do not each in turn approach the nip of the assembly progressively and uniformly from end-to-end thereof, but whereby axially successive discs have their notches circumferentially staggered in relation to one another in such a way that in a substantially equal number of instances distributed uniformly along the length of the rows the notches of axially successive discs approach the nip respectively before and after those of the immediately preceding disc in the rows.

By "axially successive discs" we means each disc in turn in numerical order taken in sequence along the row from one end thereof to the other.

According to the present invention, the notches on the discs are arranged in a predetermined sequence such that a plurality of groups of four axially successive discs are arranged such that in each group, there is no net axial thrust. This is accomplished by staggering the notches on the four discs in such a way that for each of these groups, a notch from one disc on one shaft will enter the nip first, followed by a notch on one of the discs in the group on the other shaft, followed by a notch on the other disc in the group on the other shaft followed finally by a notch on the other disc in the group on the first shaft. Thus for first, second, third and fourth axially successive discs forming such a group, wherein the first and third discs are on the first shaft and the second and fourth discs are on the second shaft, a notch on either the first or third disc will enter the nip, followed by a notch on either the second or fourth disc, followed by a notch on the other of the second or fourth disc, followed by a notch on the other of the first or third disc. The result is to minimize or eliminate axial thrust in the overall machine which would otherwise tend to bind the discs and cause noisy, rough operation.

In accordance with another feature of the present invention each shaft is provided with a plurality of such formations, whose relative angular dispositions are such that identical cutter discs can be assembled on the shaft in a plurality of different angular dispositions so that the notches on adjacent discs of each shaft are not in register with one another, the two shafts themselves being so arranged relative to one another that the notches of adjacent overlapping pairs of discs are not in register with one another.

For example, each shaft may be formed with two keyways so that discs with one internal tang can be assembled on each shaft with tangs of each axially successive disc engaged in the keyways alternatively.

In practice, the two shafts can be arranged with their keyways spaced apart by somewhat less than 180°, the precise angular spacing depending upon the number of notches on each disc. For example, in a case where there are 12 notches on each disc the centre line of one keyway may be angulary offset by 7½° from a diameter on the centre line of the other keyway.

Another possibility would be to employ a shaft of hexagonal section and discs with 12 equally spaced notches, whereby each disc could be arranged in any one of six different angular positions without the notches (if of suitable circumferential length) of two adjacent discs in any different angular disposition registering with one another.

BRIEF DESCRIPTION OF THE DRAWINGS

The invention will now be described by way of example with reference to the accompanying drawings wherein.

DESCRIPTION OF THE PREFERRED EMBODIMENT

Figure 1:
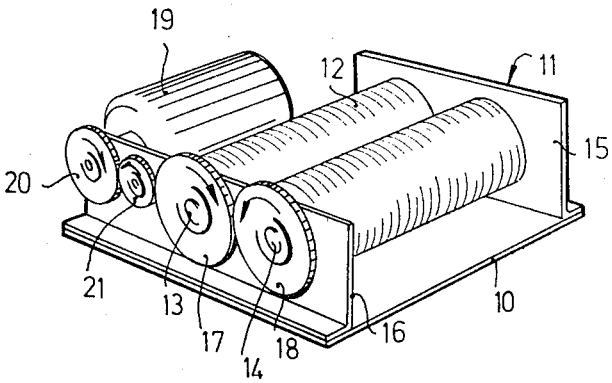
FIG. 1 is a perspective view of a typical document shredding machine with the cover removed to show the cutter assembly.

The machine shown in FIG. 1 includes a base 10 on which is mounted a cutter assembly 11 comprising a pair of cutter rollers 12 each comprising a plurality of cutter discs as hereinafter described carried by a shaft 13 or 14. The shafts are mounted for rotation in end members 15 and 16 and carry meshing gears 17 and 18 at one end which are driven from a motor 19 as shown through gears 20 and 21.

The two shafts 13 and 14 are generated together in a 1:1 ratio so as to rotate together in opposite directions at a uniform rate. Each shaft is formed with two longitudinally extending keyways 13*a*, 13*b*, and 14*a*, 14*b*, the centre line of the keyways 14*a*, 14*b* being offset by 7½° from a diameter extending centrally through the other keyways 13*a*, 13*b* respectively. As can be seen, the two shafts are so orientated relative to one another that the two keyways 13*b*, 14*b* face each other as the shafts revolve.

Figure 2:
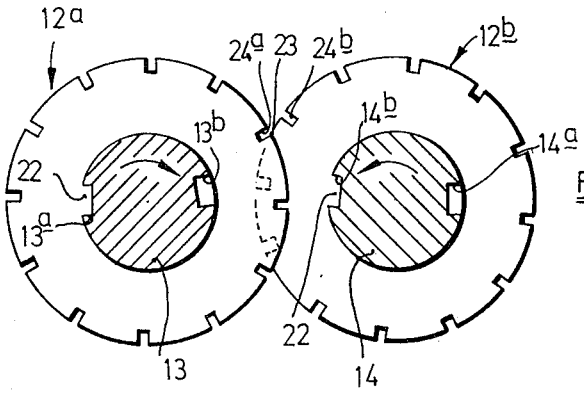
FIGS. 2 and 3 show respective transverse sections through the cutter assembly of a machine in accordance with the invention in planes perpendicular to the axes of rotation and spaced apart from one another axially by the thickness of one cutter disc so as to show the relative orientation of two adjacent pairs of overlapping discs which form a group of four axially successive discs.
Figure 3:
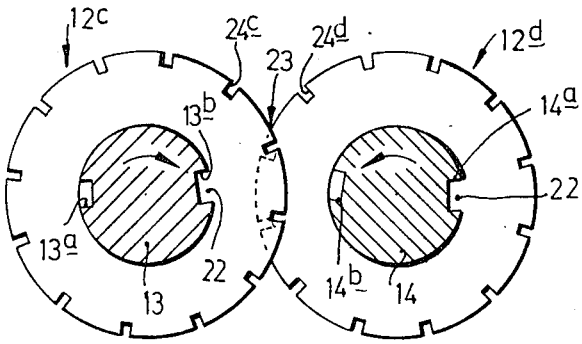

Each shaft carries a plurality of cutter discs of which four are seen in FIGS. 2 and 3 at 12*a*, 12*b*, 12*c*, and 12*d*. The cutter discs are all identical with each other and each includes an inwardly directed tang 22 adapted to enter either keyways on either shaft. The discs 12*a* and 12*c* are adjacent to one another on the shaft 13 and their tangs 22 are located respectively in the keyways 13*a* and 13*b*. Likewise, the discs 12*b* and 12*d* are adjacent to one another on the shaft 14 with their tanks 22 engaged in the keyways 14*b* and 14*a* thereof respectively. The discs 12*a* and 12*d* form an overlapping pair of which the tank 22 of one enters the keyway 13*a* of shaft 13 whilst the tang 22 of the other enters 14*b* of the shaft 14.

Figure 4:
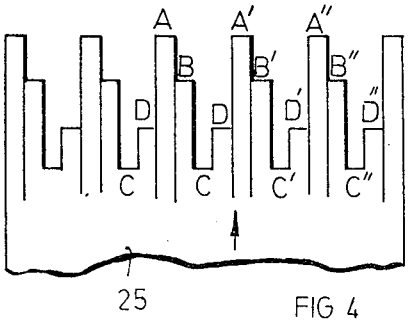
FIG. 4 is a fragmentary view of the leading edge of a piece of paper fed into the apparatus and showing the manner in which the cuts therein are formed.

Each disc is formed with 12 substantially rectangular notches spaced equally around its circumference. Due to the sequence in which the discs are arranged on shafts 13 and 14, with tanks 22 alternatively in keyways 13*a* and 13*b* or 14*a* and 14*b* respectively, the notches of each group of four adjacent discs 12*a* to 12*d* approach the nip 23 of the cutter rollers 12 in a predetermined sequence and without the notches on any adjacent pair of overlapping discs being wholly or partly in register at the nip 23. In the arrangement illustrated, as the shaft 13 and 14 rotate in the direction of the arrows, a notch 24*a* of disc 12*a* approaches the nip first, followed by a notch 24*b* of the disc 12*b*, followed by a notch 24*d* of the disc 12*d*, and finally a notch 24*c* of the disc 12*c*. Thereafter the sequence is repeated. As can be seen in FIG. 4, the transverse incisions made in a piece of paper 25 fed into the cutter assembly 11 are staggered, those indicated as A being made by the disc 12*a*, those indicated at B being made by the disc 12*b*, those indicated at C being made by the disc 12*c*, and those indicated at D being made by the disc 12*d*. The incisions, then, are made in the sequence ABDC. Similarly, incisions A′–D′ and A″–D″ are made by the next successive groups of four discs as is apparent. This sequence, then, may be described as being an ABDC sequence. Other sequences which would provide the same result would be ADBC, CBDA, or CDBA. Since substantially no net axial thrust results from such a grouping, it is not necessary that each group of four axially successive discs have the same sequence, so long as in each of the groups of four discs, wherein for example discs A and C are mounted on the same shaft and discs B and D are mounted on the same shaft, a notch on one shaft enters the nip followed sequentially by notches on the two discs on the other shaft in either sequence, followed by a notch on the remaining disc on the first shaft.

In order to ensure that the notches of the overlapping discs on the two shafts do not register with another at the nip of the roller assembly, it is only necessary to ensure that when the gears 17 and 18 are secured to the shafts 13 and 14 in meshing relationship, the two shafts are disposed with the keyways 13*b* and 14*b* (or 13*a* and 14*a*) facing one another as shown in FIGS. 2 and 3, and in assembling the individual discs on each shaft, it is merely necessary for the tangs 22 of successive discs to be arranged in the two keyways alternatively.

In this way, utilising only a single type of cutter disc and a relatively simple assembly procedure, it is possible to construct a cross out shredding machine which operates smoothly and yet employs a more economical type of cutter construction formed from separate cutter discs keyed to shafts.

While this represents a particularly convenient and economical embodiment, it would alternatively be possible, as previously mentioned, to form each shaft with only a single keyway and to provide two different types of cutter discs, the tangs of which are disposed differently relative to the notches so as to achieve the same effect of offsetting the notches in adjacent discs on the shaft when such two types of discs are alternatively assembled thereon. While it is most convenient to form a keyway in the shaft and provide a tang on each disc, it will be appreciated that the converse arrangement could be adopted in this case, namely each disc could be formed with a recess opening into its central aperture, and the shaft could be formed with a single rib, the positions of the recesses differing in the two types of disc.

While in the embodiments thus far described it is sufficient to provide for only two alternatively relative positions for each disc, it will be appreciated that it would be possible to provide three or more keyways etc.

Figure 5:
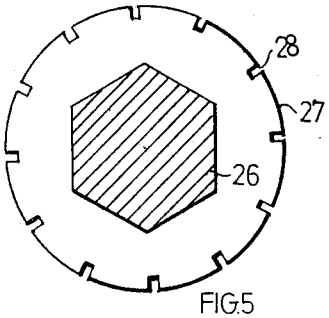
FIG. 5 illustrates an alternative type of cutter disc.

A further alternative is illustrated in FIG. 5, wherein instead of the use of keyways on the shafts and associated tangs on the discs, a noncircular cross section shaft may be utilized. In this case, the shaft shown at 26 is of hexagonal cross section and the disc 27 is formed with a corresponding hexagonal central aperture through which the shaft extends, and the notches 28 are formed in the periphery thereof.

Thus, in all embodiments, the effect of the staggered arrangement of notches is to distribute the impact of the transverse edges (which are formed where the notches interrupt the peripheries of the discs) substantially uniformly around the periphery of the cutter rollers and substantially uniformly along the length thereof so that a substantially constant driving torque is required which is less than would be necessary if a notch on every disc of one roller engaged the paper simultaneously. Moreover, any axial forces exerted on the individual discs are compensated so that there is no overall tendency for the discs to move in one direction and become packed together.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. In a document shredding machine comprising:

a cutter assembly including a plurality of cutter discs arranged in two parallel rows, the discs of one row entering the gaps between the discs of the other row so as to cooperate therewith, first and second parallel shafts on which said discs are each separately mounted; keying means on said discs and said shafts, means for rotating said shafts and thereby said discs in opposite directions about their longitudinal axes and causing said discs to sever material fed between the rows into strips, and notches formed in the periphery of each disc to divide such strips into short lengths, the invention wherein:

said discs are arranged in a plurality of groups of first, second, third and fourth axially successive discs wherein in each of said groups of said first and third discs are mounted on said first shaft and of said second and fourth discs are mounted on said second shaft, said notches on said discs being circumferentially staggered in relation to each other such that upon rotation of said shafts, a notch on one of said first and third discs will enter the nip of the cutter assembly followed by a notch on one of said second and fourth discs, followed by a notch on the other of said second and fourth discs, followed by a notch on the other of said first and third discs sequentially.

2. A document shredding machine as claimed in claim 1 wherein each shaft is provided with a plurality of keying means whose relative angular dispositions are such that identical cutter discs each having a single keying member can be assembled on each such shaft in a plurality of different angular dispositions so that the notches on adjacent discs of each shaft are not in register with one another, the two shafts themselves being so arranged relative to one another that the notches of adjacent overlapping pairs of discs are not in register with one another.

3. A document shredding machine as claimed in claim 2 wherein said keying means on each shaft comprise two keyways and the keying member on each disc comprises a single internal tang, and the discs are assembled on each shaft with their respective tangs engaged in the two keyways of the shaft alternatively.

4. A document shredding machine as claimed in claim 3 wherein said two keyways on each shaft are spaced apart circumferentially by somewhat less than 180°.

5. A document shredding machine as claimed in claim 4 wherein the centre line of one of said keyways is angularly offset by $7\frac{1}{2}°$ from a diameter on the centre line of the other keyway, and each cutter disc includes with 12 equally spaced notches around its periphery.

* * * * *